US007114455B2

(12) United States Patent
Prüfer et al.

(10) Patent No.: US 7,114,455 B2
(45) Date of Patent: Oct. 3, 2006

(54) THREAD SPOOL HOLDER FOR A PLURALITY OF NEEDLE THREAD SPOOLS

(75) Inventors: Frank Prüfer, Rielasingen (DE); Michael König, Constance (DE); André Stucki, Steckborn (CH)

(73) Assignee: Fritz Gegauf Aktiengesellschaft BERNINA-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 11/319,810

(22) Filed: Dec. 28, 2005

(65) Prior Publication Data

US 2006/0150880 A1 Jul. 13, 2006

(30) Foreign Application Priority Data

Jan. 12, 2005 (CH) ..... 00037/05

(51) Int. Cl.
*D05B 34/00* (2006.01)
*D05B 73/02* (2006.01)

(52) U.S. Cl. ..... 112/302; 112/258

(58) Field of Classification Search ..... 112/302, 112/258, 259, 270; 242/170, 171, 590, 600, 242/118, 157 C
See application file for complete search history.

(56) References Cited

U.S. PATENT DOCUMENTS

| | | | | |
|---|---|---|---|---|
| 1,730,431 | A * | 10/1929 | Keefer | 242/129.8 |
| 2,390,571 | A | 12/1945 | Colegrove | |
| 2,871,808 | A | 2/1959 | Matuzas | |
| 2,900,941 | A * | 8/1959 | Platt | 112/270 |
| 2,940,685 | A | 6/1960 | Glass | |
| 3,645,220 | A | 2/1972 | Casas-Robert | |
| 3,749,039 | A * | 7/1973 | Fritts | 112/302 |
| 4,936,234 | A * | 6/1990 | Jimenez et al. | 112/259 |
| 5,063,866 | A * | 11/1991 | Jimenez et al. | 112/302 |
| 5,441,003 | A * | 8/1995 | Hashiride | 112/259 |
| 6,467,419 | B1 | 10/2002 | Hori | |
| 6,729,252 | B1 * | 5/2004 | Wada et al. | 112/278 |

FOREIGN PATENT DOCUMENTS

| | | |
|---|---|---|
| JP | 08071278 | 3/1996 |
| JP | 10328459 | 12/1998 |
| JP | 2002-325989 | 11/2002 |
| JP | 2003-144784 | 5/2003 |
| JP | 2004-242980 | 9/2004 |

* cited by examiner

*Primary Examiner*—Ismael Izaguirre
(74) *Attorney, Agent, or Firm*—Volpe and Koenig, P.C.

(57) ABSTRACT

In an upright (3) of a sewing machine (1), a thread spool holder (24) is mounted in a recess (13) so that it can pivot out of the recess (13). On this holder, thread spool pins (23) are placed, as well as an arm (35), on whose upper end thread guidance elements (33) are fixed. For use, the cover (15) which covers the thread spool holder (24) in the stowed state is opened, and the thread spool holder (24) is pivoted out from the recess (13).

12 Claims, 7 Drawing Sheets

THREAD SPOOL HOLDER FOR A PLURALITY OF NEEDLE THREAD SPOOLS

BACKGROUND

Figure 1:
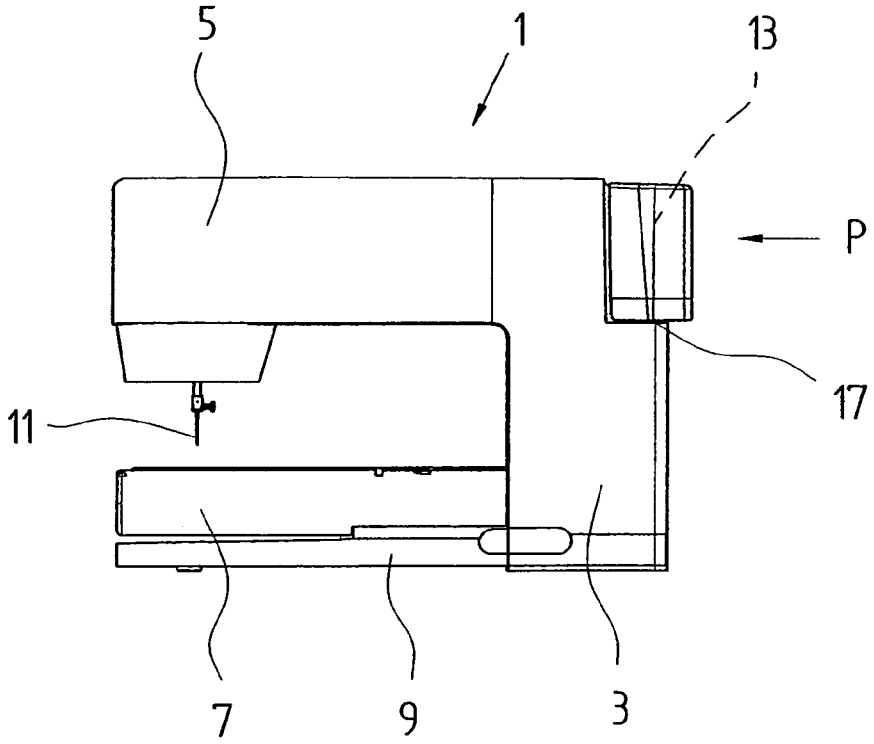

The present invention relates to a thread spool holder for a plurality of needle thread spools.

On household sewing machines, a pin for holding a thread spool, also called a needle thread spool, is mounted typically on the part near the upright, for the most part on the top side or on the rear side. The pin can be arranged vertically or horizontally and is often formed so that it can be moved and lowered axially into the sewing machine when the sewing machine is being transported or not being used.

In the course of expanded possible uses for household sewing machines, especially if embroidering devices are used on these machines with suitable adapters, for each color change of the needlework, the needle thread and thus the needle thread spool must be exchanged. Consequently, several needle thread spools with various threads or thread colors are required. In commercial sewing machines or embroidery machines, for this purpose it is known to arrange multiple thread spool holders, in multiple in the configuration of so-called carousels, next to the sewing machine. It is further known to place such multiple thread spool holders above the sewing area on the upper arm of the sewing machine. Because commercial embroidery machines are always set at a fixed location and do not have to be put away after use, these usually rather voluminous thread spool carousels, which are free-standing or arranged above the embroidery machine, do not disrupt the handling of the machine. Such known devices are not suitable for household sewing machines, which are put away in a case after use and for which there is often very little room in the homes.

SUMMARY

One objective of the present invention is to create a thread spool holder for a plurality of needle thread spools on household sewing machines, which do not negatively affect the handling of the sewing machine and which further enables sewing or embroidery within the previously typical scope.

This objective is solved by a thread spool holder for a plurality of needle threads according to the invention.

Especially advantageous configurations of the invention are described below.

Through the configuration and arrangement according to the invention for the base plate of the thread spool holder, this base plate can be placed completely in the housing of the sewing machine—if it is equipped with few needle thread spools. When the base plate is equipped with a significantly larger number of needle thread spools and/or larger spools, the base plate is placed at the side of the upright so it does not negatively affect the sewing and embroidery. In an advantageous configuration of the invention, the needle thread can be drawn off over the head, i.e., parallel to the rotational axis of the spool, or tangentially, whereby twisting of the thread can be prevented. The spool position suitable for tangential drawing is also an advantageous position for feeding thread to the bobbin of the under thread bobbin. For drawing the thread over the head and tangentially, an arm that can be extended in a telescoping manner is arranged on the base plate and enables the drawn thread to be drawn and guided from the spool in a suitable way. Without the aid of tools, the base plate can be removed from the sewing machine and replaced by an equivalent base plate, which is equipped with differently colored and/or different type of thread, or by a base plate with a larger or smaller number of spool receivers.

The thread spool carousel, which can hold only a limited number of thread spools, is integrated completely into the machine housing and is therefore protected against dust when the machine is not in use. According to the type of thread spools, changeable thread spool pins can be inserted into the base plate. The thread spool carousel according to the invention can be provided with a pattern, which indexes the rotational movement, i.e., which brings the selected thread spool to the correct draw-off position. The carousel can also be removed from the machine and replaced by a different carousel, whether it be a larger or a smaller carousel. Larger carousels can be set, particularly when the sewing machine is used for embroidery. In addition to a larger base plate, which enables the storage of a larger number of thread spools, base plate segments can also be docked to the edge of the base plate. In one especially advantageous configuration of the invention, the base plates of the thread spool holder can be shaped so that they can be turned by an electric drive, which is preferably arranged in the sewing machine, and positioned according to the thread spools.

BRIEF DESCRIPTION FO THE DRAWINGS

Figure 2:
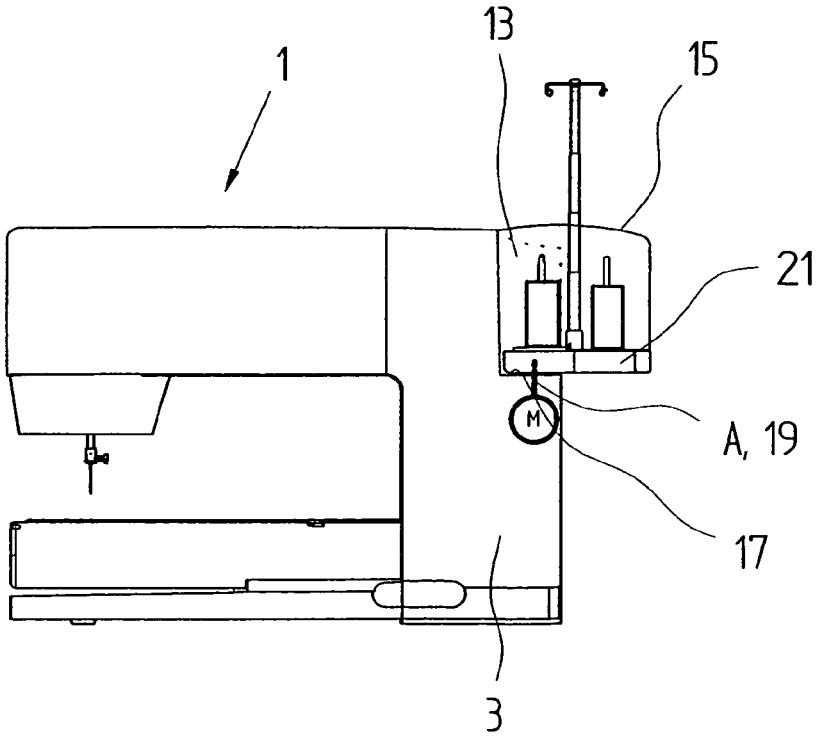
Figure 3:
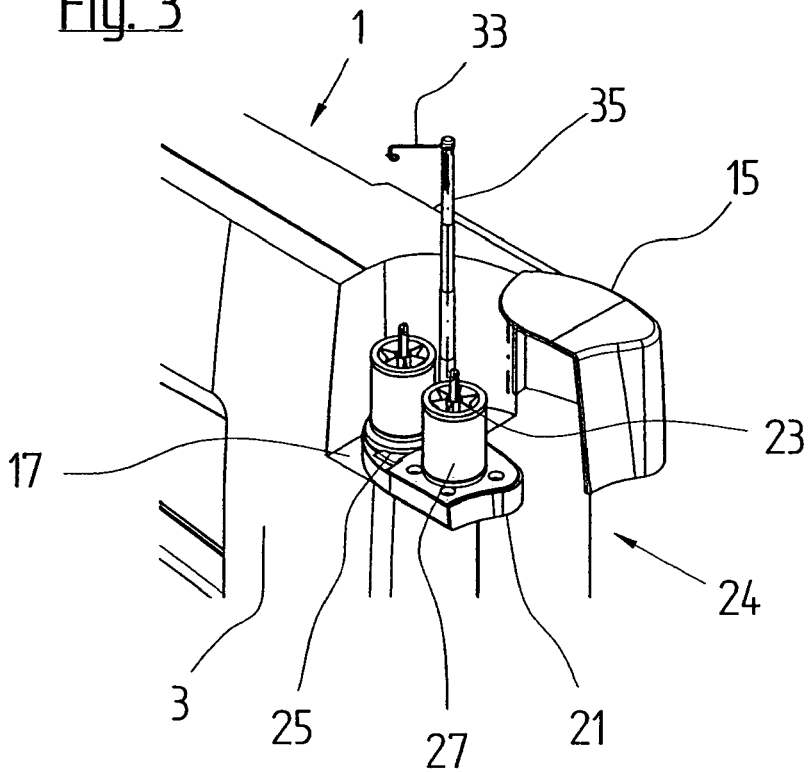
Figure 4:
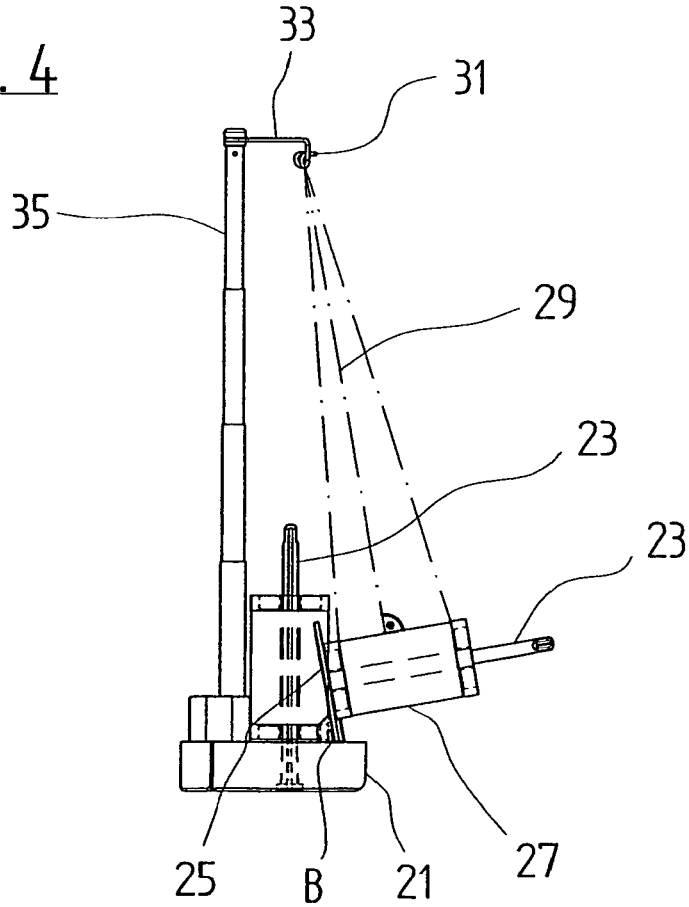
Figure 5:
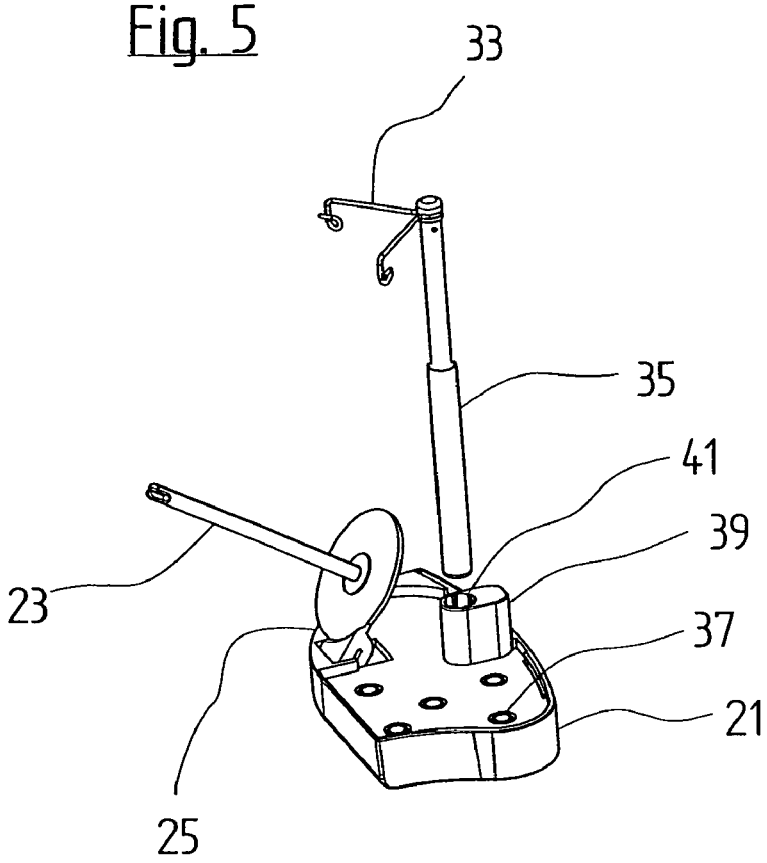
Figure 6:
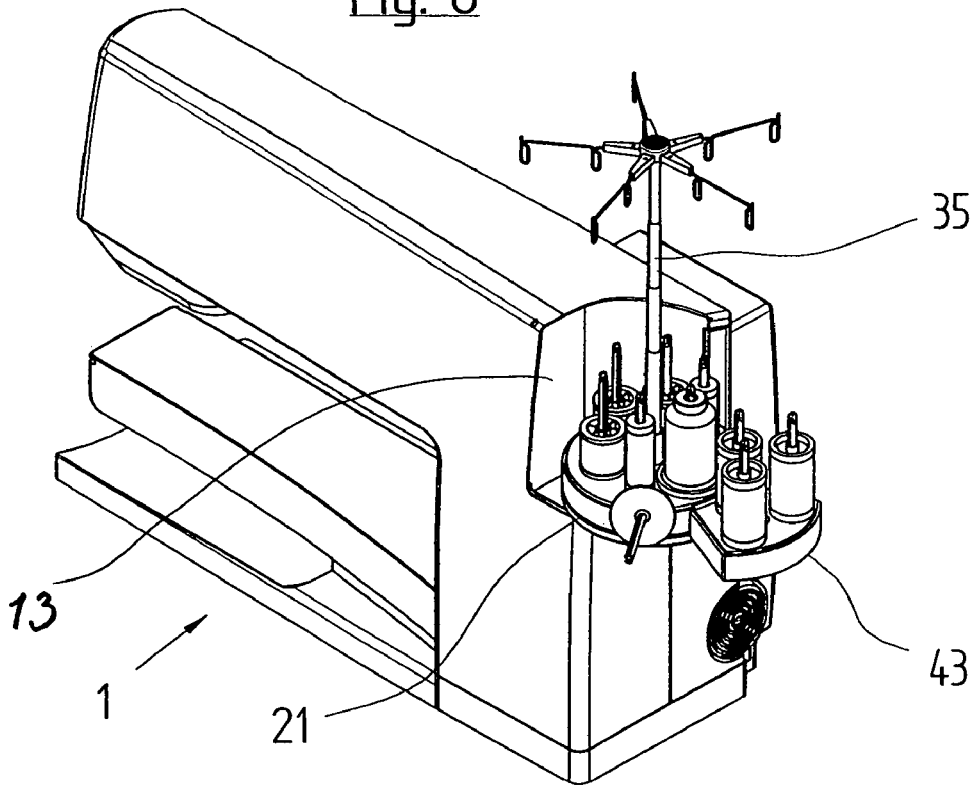
Figure 7:
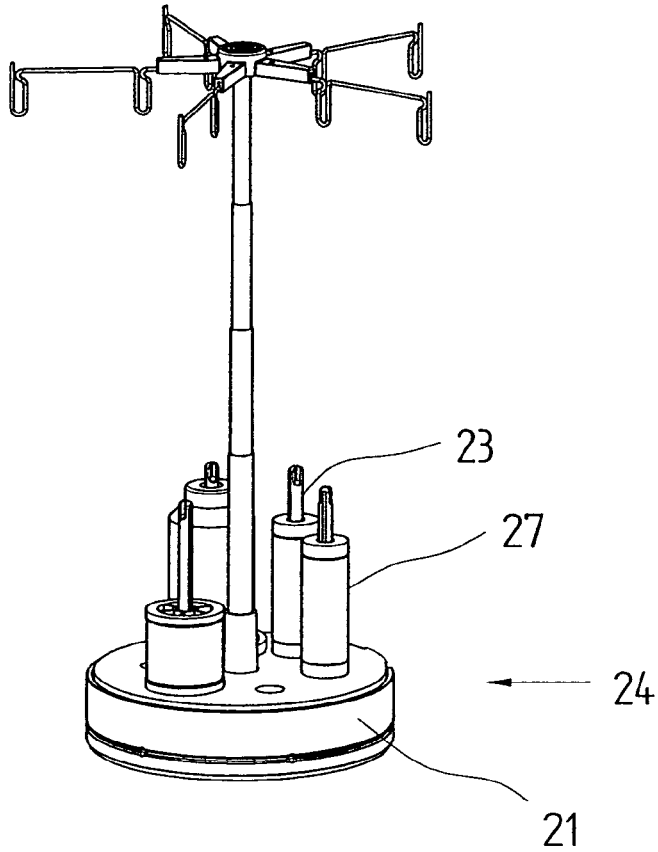
Figure 8:
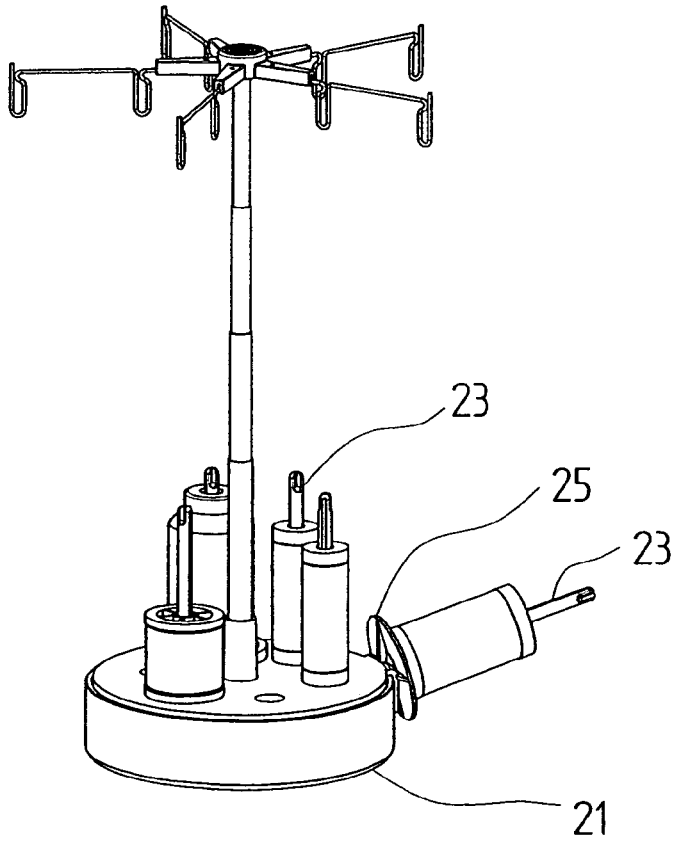
Figure 9:
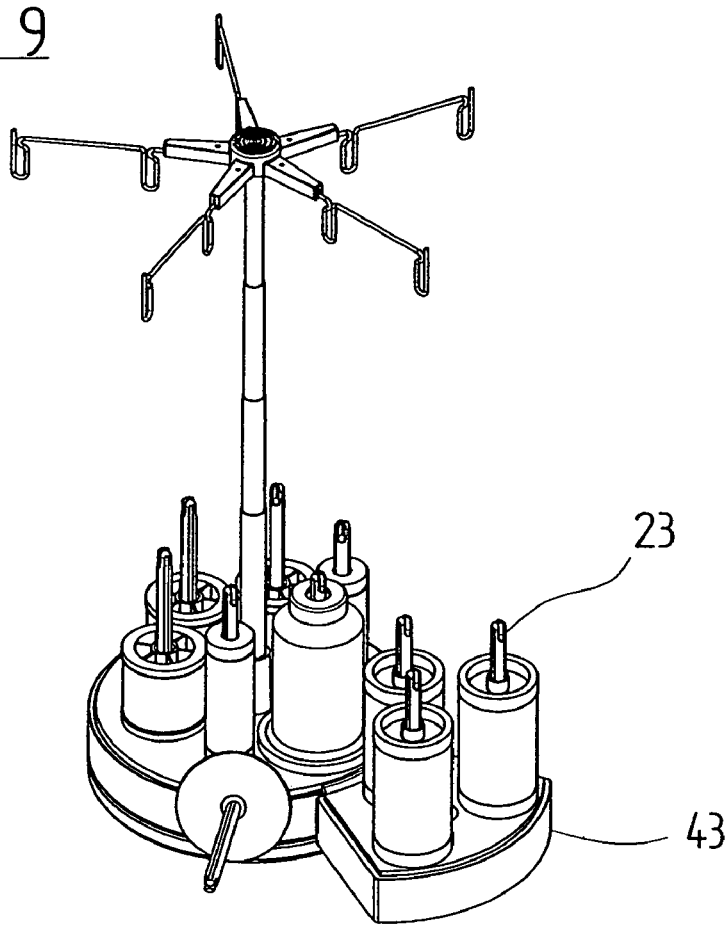
Figure 10:
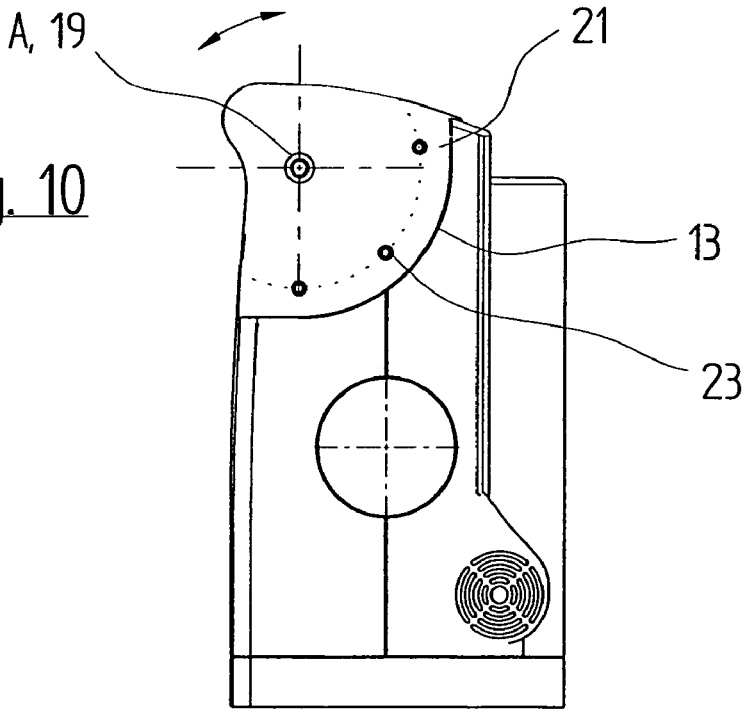
Figure 11:
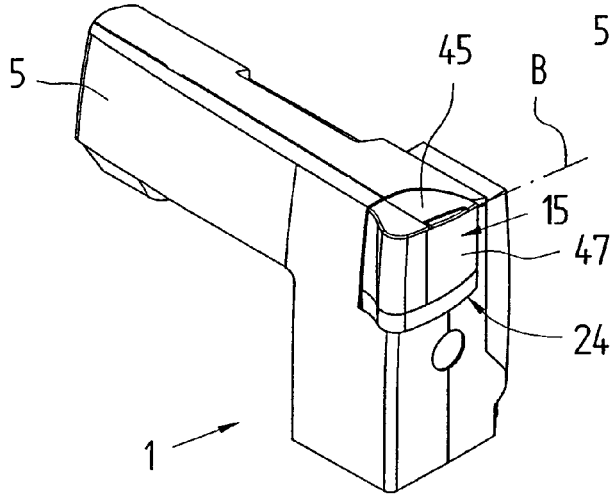
Figure 12:
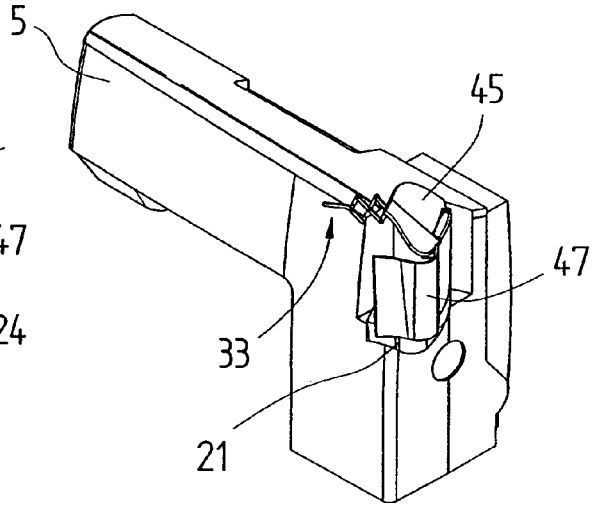
Figure 13:
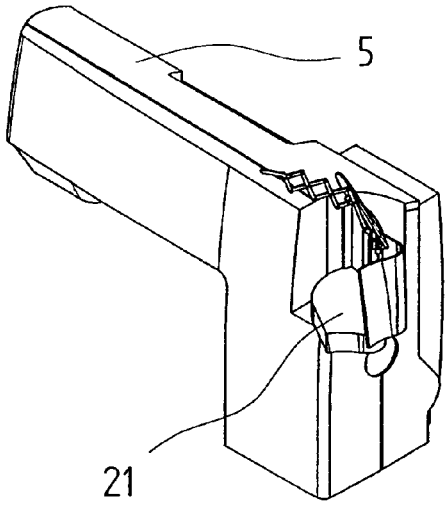
Figure 14:
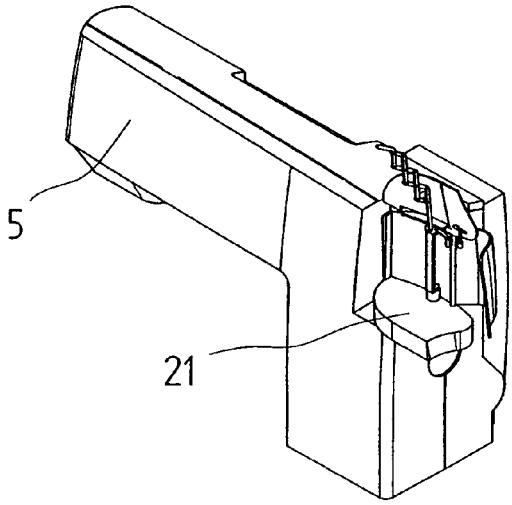
Figure 15:
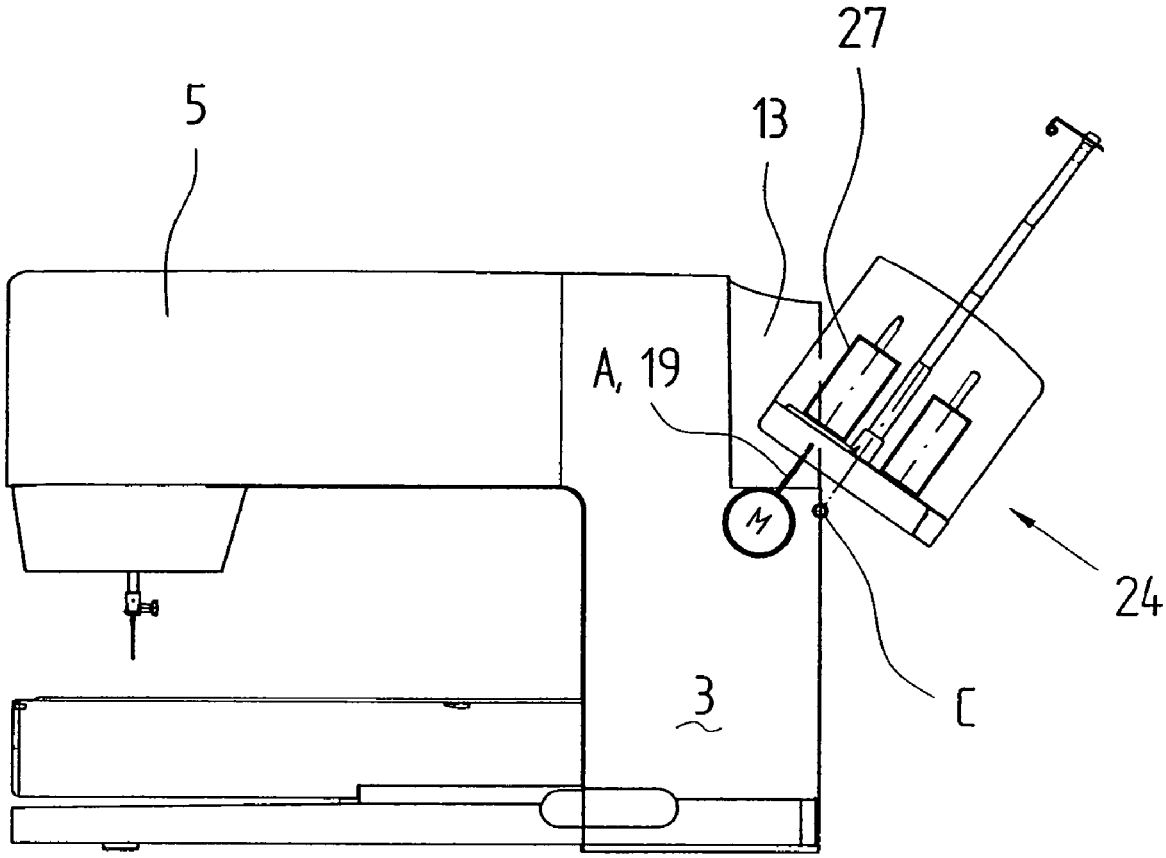

The invention is explained in more detail with reference to an illustrated embodiment. Shown are:

FIG. 1 is a schematic view of a household sewing machine from the operator side with a closed thread spool receiver, FIG. 2 is a schematic view of a household sewing machine from the operator side with an opened thread spool receiver, FIG. 3 is an enlarged perspective representation of the thread spool receiver on the upright of the sewing machine, FIG. 4 is a view of the pivoting thread spool receiver pin (in the foreground) and a fixed thread spool receiver pin, FIG. 5 a perspective representation of the base plate of the thread spool holder with a plurality of pin receivers, FIG. 6 is a perspective representation of a household sewing machine with a thread spool carousel with an additional docked thread spool holder (satellite), FIG. 7 is a perspective representation of a circular thread spool holder, FIG. 8 is a perspective representation of a circular thread spool holder with a satellite with inclined rotational axis, FIG. 9 is a view of a thread spool holder with a satellite with three additional thread spool pins and thread spools placed thereon, FIG. 10 is a view of the sewing machine from the direction of the arrow P in FIG. 1 with a thread spool carousel that can rotate about a horizontal rotational axis, FIG. 11 is a perspective partial view with pivoted thread spool receiver in another embodiment of the invention, FIG. 12 is a perspective partial view with thread spool receiver rotated by 30°, FIG. 13 is a perspective partial view with thread spool receiver rotated by 60°, FIG. 14 is a perspective partial view with thread spool receiver rotated by 90°, FIG. 15 is a perspective partial view with thread spool receiver pivoted about a horizontal axis.

DETAILED DESCRIPTION OF THE PREFEFRED EMBODIMENTS

In a household sewing machine 1, an upright is designated with the reference symbol 3, in which the driving elements for the sewing machine 1 are housed and on whose left side the upper arm 5 and the free arm 7 are cantilevered. The upright 3 stands on a base 9 on the rear part removed from the sewing area with the needle 11. On the upright 3, a recess 13 is formed at the top in the housing of the sewing machine 1, which is open against the top and the side and which can be closed by a cover 15. A base plate 21 can rotate or pivot about a vertical axis A on a pivot pin 19 above the base surface 17 of the recess 13. In one especially advantageous configuration, the pivot pin 19 is connected to an electric drive M, with which the base plate 21 can rotate. Two thread spool pins 23 are mounted on the base plate 21 shown in FIGS. 2 to 4. One of the two thread spool pins 23 is anchored rigidly in the base plate 21; the second thread spool pin 23 can pivot with a holding plate 25 that can pivot about a horizontal pivoting axis B. Together, the base plate 21 and the thread spool pins 23 form a thread spool carousel, called thread spool holder 24 below. Suitable means, not visible in the figures, limit the pivoting range of the holding plate 25, such that thread 29 running tangentially off a spool 27 runs perpendicular to the thread spool pin 23, when it is drawn through an eyelet 31 of a thread guidance element 33. The thread guidance element 33 is mounted to the tip of an arm or a telescoping arm 35 (FIG. 4).

In FIG. 5, a base plate (21), for example, for five of these thread spool pins 23 that can be anchored, is shown. The thread spool pins 23 (in this figure, only the thread spool pin 23 inserted onto the holding plate 25 is shown) are held in accordingly shaped bore holes 37 formed in the base plate 21. Also, the arm 35 can be inserted either directly into the base plate 21 or into a holder 39 attached thereto. The holder 39 can feature, in addition to the bore hole 41 for the arms 35, a bore hole, which is not visible in FIG. 5, which is formed from below, and in which the pivot pin 19, which is fixed to the sewing machine 1, engages and carries the base plate 21 together with the elements fixed thereon in a freely pivotable or positive-fit connection way.

Preferably, the shape of the base plate 21 corresponds to the shape of the base surface 17 in the recess 13. This enables the base plate 21 to be pivoted together with the elements arranged thereon into the recess 13 and to be stored out-of-sight by pivoting the cover 15 coupled with the housing of the sewing machine 1.

In another configuration of the invention according to FIGS. 6 to 9, which is suitable, in particular, for embroidery work with a plurality of different threads 29, the spatial extension of the base plate 21 is significantly greater, i.e., it projects past the base surface 17 of the recess 13 (cf. FIG. 6), whereby a larger number of spools 27 can be held.

In FIG. 7, on such a base plate 21, four thread spool pins 23 with thread spools 27 set thereon can be seen. The base plate 21 is, in turn, set on the pivot pin 19 in the recess 13 on the upright 3 of the household sewing machine 1. This thread spool holder 24 can then rotate about the pivot pin 19, but it cannot be housed completely within the machine housing covered by a cover 15.

FIG. 8 shows the same base plate 21 with a smaller number, namely four, thread spool pins 23. In addition, at the edge of the base plate 21, a satellite 43 with a thread spool pin 23 and a corresponding holding plate 25 is set. The thread spool pin 23 lies at an acute angle to the other thread spool pins 23 arranged on the base plate 21 and thus enables a tangential thread run-off to the thread guidance element 33 on the arm 35.

A similar arrangement of a satellite 43, but provided with a plurality of thread spool pins 23, is shown in FIG. 9. Obviously, not only a single, but instead several equal-size or unequal-size satellites 43 can be docked to the base plate 21. In addition, other such satellites can be placed at the periphery of the satellites 43, such that a very large number of thread spool pins 23 or thread spools 27 can be connected to the sewing machine 1.

In the schematic view of the sewing machine 1 according to FIG. 10, it can be seen that the pivot pin 19 is arranged horizontally in the recess 13 and the base plate 21 can consequently pivot in a vertical plane. Here, the thread spool pins 23 lie horizontally or, if they are arranged on a pivoting holding plate 25, they can also be pivoted into a vertical position.

The cover 15, with which the thread spool carousel 24 can be covered in the sewing machine 1, can be actively connected to the base plate 21, such that when the cover 15 opens, the thread spool carousel 24 is pivoted out of the recess 13 or when the cover 15 closes, it is pivoted into the recess 13. As an alternative to a positive-fit connection between the cover 15 and the base plate 21, obviously an electric drive can also be provided, which pivots the base plate 21 out from the machine 1 when the cover 15 opens and if need be also triggers its rotation on the pivot pin 19, in order to bring the desired spool 27 into position.

In another configuration of the invention according to FIGS. 11 to 15, which show another configuration of the invention, a cover plate 45, which can pivot about a horizontal axis B and which is coupled to the essentially vertical side walls 47 of the cover, is shown. The thread spool carousel 24 can pivot, as in the first embodiment, about a vertical axis away from the upright 3 of the sewing machine 1. When the thread spool carousel 24 pivots, for example, by 30° as shown in FIG. 12, not only does the cover plate 45 pivot upwards, but the side walls 47 are also pivoted about a vertical axis away from the base plate 21, in order to expose the spools 27 arranged on the base plate 21 and not shown in the example. During the pivoting motion of the base plate 21, the thread guidance element 33, which in this example has the shape of lazy tongs, begins to extend and to pivot upwards (compare pivot angle 60° of base plate 21 and pivot angle 90° of base plate 21 in FIGS. 13 and 14, respectively). Consequently, due to the pivoting motion, the thread spool carousel 24 is completely exposed and simultaneously the thread guidance element 33 is extended and pivoted into the working position. In one especially advantageous configuration of the invention according to FIG. 15, the thread spool carousel 24, which can be a carousel such as in the first embodiment according to FIGS. 1 to 9 or a carousel such as according to FIGS. 11 to 14, can be pivoted as a whole about a horizontal axis C. Through the pivoting movement, the spools 27 still partially located within the recess 13 at the beginning are moved completely out from the area of the upright 3.

LEGEND

1 Household sewing machine
3 Upright
5 Upper arm
7 Free arm
9 Base
11 Needle

13 Recess
15 Cover
17 Base surface
19 Pivot pin
21 Base plate
23 Thread spool pins
24 Thread spool carousel
25 Holding plate
27 Needle thread spool
29 Thread
31 Eyelet
33 Thread guidance element
35 Arm
37 Bore holes
39 Holder for 35
41 Bore hole
43 Satellite
45 Cover plate
47 Side walls

The invention claimed is:

1. Thread spool holder (24) for at least one needle thread spool (27) on a household sewing machine (1), comprising at least two thread spool pins (23) as spool carriers, a base plate (21) for anchoring the thread spool pins (23), an arm (35) for guiding and deflecting a thread (29) drawn out from one of the spools (27), and a connection for connecting the base plate (21) to the sewing machine (1), the base plate (21) is held engaged at least partially in a recess (13) in the housing of the sewing machine (1) and is mounted for pivoting movement about at least one pivot axis (A, C), wherein the base plate (21) is supported so that it can pivot at least partially out of the recess (13), and the base plate (21) is supported on a pivot pin (19) on the sewing machine (1).

2. Thread spool holder according to claim 1, wherein the pivot axis (A) is arranged generally horizontally, vertically, or in an intermediate position.

3. Thread spool holder according to claim 2, wherein a shape of the base plate (21) corresponds to a shape of the base surface (17) of the recess (13), and the recess (13) can be closed and covered by a cover (15).

4. Thread spool holder according to claim 3, wherein the base plate (21) is actively connected to the cover (15) and is extended or pivoted out of the recess (13) upon opening.

5. Thread spool holder according to claim 1, wherein the base plate (21) can rotate freely on the pivot pin (19) or can rotate with a drive motor (M), and the pivot pin (19) is connected rigidly or is pivotable about an axis (C) relative to the sewing machine (1).

6. Thread spool holder according to claim 1, wherein at least one of the thread spool pins (23) is fixed on a holding plate (25) that can pivot on the base plate (21) about a horizontal axis and can pivot or move from a vertical position into an inclined position.

7. Thread spool holder according to claim 6, wherein the base plate (21) can be removed from the pivot pin (19) and can be exchanged with another base plate (21).

8. Thread spool holder according to claim 1, wherein additional satellites (43), on which at least one thread spool pin (23) is arranged, can be placed on the base plate (21).

9. Thread spool holder according to claim 8, wherein the cover (15) and/or an upper cover plate (45) and/or side walls (47) are pivoted away from the base plate when the base plate (21) is pivoted.

10. Thread spool holder (24) for at least one needle thread spool (27) on a household sewing machine (1), comprising at least one thread spool pin (23) as a spool carrier, a base plate (21) for anchoring the at least one thread spool pin (23), an arm (35) for guiding and deflecting a thread (29) drawn out from the spool (27), and a connection for connecting the base plate (21) to the sewing machine (1), the base plate (21) is held engaged at least partially in a recess (13) in the housing of the sewing machine (1) and is mounted for pivoting movement about at least one pivot axis (A, C), wherein at least one of the thread spool pins (23) is fixed on a holding plate (25) that can pivot about a horizontal axis and can pivot or move from a vertical position into an inclined position, and the base plate (21) can be removed from the pivot pin (19) and can be exchanged with another base plate (21).

11. Thread spool holder (24) for at least one needle thread spool (27) on a household sewing machine (1), comprising at least one thread spool pin (23) as a spool carrier, a base plate (21) for anchoring the at least one thread spool pin (23), an arm (35) for guiding and deflecting a thread (29) drawn out from the spool (27), and a connection for connecting the base plate (21) to the sewing machine (1), the base plate (21) is held engaged at least partially in a recess (13) in the housing of the sewing machine (1) and is mounted for pivoting movement about at least one pivot axis (A, C), wherein additional satellites (43), on which at least one thread spool pin (23) is arranged, can be placed on the base plate (21).

12. Thread spool holder according to claim 11, wherein the cover (15) and/or an upper cover plate (45) and/or side walls (47) are pivoted away from the base plate when the base plate (21) is pivoted.

* * * * *